US008050607B2

(12) United States Patent
Shinshi et al.

(10) Patent No.: US 8,050,607 B2
(45) Date of Patent: Nov. 1, 2011

(54) IMAGE FORMING APPARATUS, FIXING UNIT, AND IMAGE FORMING METHOD WITH A CLEANING MECHANISM THAT CONTACTS A TENSION MECHANISM

(75) Inventors: Akira Shinshi, Machida (JP); Hiroshi Seo, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 859 days.

(21) Appl. No.: 11/477,662

(22) Filed: Jun. 30, 2006

(65) Prior Publication Data

US 2007/0003334 A1 Jan. 4, 2007

(30) Foreign Application Priority Data

Jun. 30, 2005 (JP) ..... 2005-193038

(51) Int. Cl.
*G03G 15/20* (2006.01)

(52) U.S. Cl. ..... 399/327; 399/329

(58) Field of Classification Search ..... 399/327–329, 399/320, 122, 324–326
See application file for complete search history.

(56) References Cited

U.S. PATENT DOCUMENTS 6,134,400 A * 10/2000 Higashi et al. ..... 399/328
6,477,344 B1 * 11/2002 Asakura et al.
6,594,464 B2 * 7/2003 Hayashi et al. ..... 399/327
6,792,236 B2 * 9/2004 Yoda et al.
6,882,820 B2 4/2005 Shinshi et al.
2005/0163543 A1 7/2005 Satoh et al.
2006/0002737 A1 1/2006 Shinshi
2006/0233574 A1 * 10/2006 Inada ..... 399/327

FOREIGN PATENT DOCUMENTS

JP 06110352 A * 4/1994
JP 8-334997 12/1996
JP 9-218601 8/1997
JP 10-20696 1/1998
JP 3243143 10/2001
JP 2002-123111 4/2002
JP 2002-365952 12/2002
JP 2003-131505 5/2003

OTHER PUBLICATIONS

U.S. Appl. No. 11/945,693, filed Nov. 27, 2007, Shinshi.
U.S. Appl. No. 11/669,699, Jan. 31, 2007, Shinshi.

* cited by examiner

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

An image forming apparatus includes an image forming mechanism for forming an image on a recording medium with a developer according to image data and a fixing mechanism for fixing the developer forming the image on the recording medium. The fixing mechanism includes a pressing member, a fixing member, a tension roller, and a cleaner. The fixing member and the pressing member respectively apply heat and pressure to the recording medium conveyed through a nip formed between the pressing member and the fixing member. The tension roller contacts one of the pressing member and the fixing member that contacts the developer forming the image on the recording sheet to apply tension to the one of the pressing member and the fixing member. The cleaner contacts the tension roller and removes contaminants including the developer adhered to the tension roller.

12 Claims, 5 Drawing Sheets

IMAGE FORMING APPARATUS, FIXING UNIT, AND IMAGE FORMING METHOD WITH A CLEANING MECHANISM THAT CONTACTS A TENSION MECHANISM

CROSS-REFERENCE TO RELATED APPLICATION

The present application is based on and claims priority to Japanese patent application No. 2005-193038 filed on Jun. 30, 2005 in the Japan Patent Office, the entire contents of which are hereby incorporated herein by reference.

BACKGROUND

1. Field of Invention

Exemplary aspects of the present invention relate to an image forming apparatus, a fixing unit, and an image forming method, and more particularly to an image forming apparatus, a fixing unit, and an image forming method with an enhanced cleaning mechanism for removing contaminants including toner particles.

2. Description of the Related Art

A background image forming apparatus, such as a copying machine, a printer, or a facsimile machine, forms an image on a recording medium (i.e., a recording sheet) in an electrophotographic or electrostatic method. Specifically, an electrostatic latent image is formed on a uniformly charged photoconductor according to image data. The electrostatic latent image is visualized with a developer (e.g., toner) to form a toner image on the photoconductor. The toner image is transferred onto a recording sheet and the recording sheet having the toner image is conveyed to a fixing unit in which heat and pressure fix the toner image on the recording sheet.

One example of a related art fixing unit includes a fixing roller including a heater and a pressure roller opposing the fixing roller. The fixing roller and the pressure roller respectively apply heat and pressure to the recording sheet to fix the toner image on the recording sheet while the recording sheet is conveyed through a nip formed under pressure between the fixing roller and the pressure roller.

Another example of a related art fixing unit includes a fixing belt, a heating roller including a heater, a fixing roller, and a pressure roller. The fixing belt is looped over the heating roller and the fixing roller. The pressure roller opposes the fixing roller via the fixing belt. The heating roller heats the fixing belt. The fixing belt and the pressure roller respectively apply heat and pressure to the recording sheet to fix the toner image on the recording sheet while the recording sheet is conveyed through a nip formed under pressure between the fixing belt and the pressure roller.

In the above-described fixing units, contaminants, including toner particles not completely fixed and paper dust, may be transferred from the recording sheet to the fixing roller or the fixing belt due to temperature and electrostatic factors while the recording sheet is conveyed through the nip formed under pressure between the fixing roller or the fixing belt and the pressure roller. The contaminants transferred onto the fixing roller or the fixing belt may be further transferred onto the pressure roller opposing the fixing roller or the fixing belt because the pressure roller is not configured to release the contaminants as easily as the fixing roller or the fixing belt. When the transferred contaminants are accumulated on the pressure roller, a part or all of the accumulated contaminants may be transferred onto a following recording sheet conveyed through the nip formed under pressure between the fixing roller or the fixing belt and the pressure roller. As a result, the recording sheet or the toner image on the recording sheet may be damaged.

SUMMARY

This specification describes below an image forming apparatus according to an exemplary embodiment of the invention. In one aspect of the present invention, the image forming apparatus includes an image forming mechanism configured to form an image on a recording medium with a developer according to image data and a fixing mechanism configured to fix the developer forming the image on the recording medium. The fixing mechanism includes a pressing member, a fixing member, a tension roller, and a cleaner. The pressing member is configured to apply pressure to the recording medium. The fixing member opposes the pressing member and is configured to apply heat to the recording medium conveyed through a nip formed between the pressing member and the fixing member. The tension roller is disposed at a position to contact one of the pressing member and the fixing member that contacts the developer forming the image on the recording sheet to apply tension to the one of the pressing member and the fixing member. The cleaner is disposed at a position to contact the tension roller and is configured to remove contaminants including the developer adhered to the tension roller.

This specification further describes a fixing unit according to one exemplary embodiment of the invention. In one aspect of the present invention, the novel fixing unit includes a pressing member, a fixing member, a tension roller, and a cleaner. The pressing member is configured to apply pressure to the recording medium. The fixing member opposes the pressing member and is configured to apply heat to the recording medium conveyed through a nip formed between the pressing member and the fixing member. The tension roller is disposed at a position to contact one of the pressing member and the fixing member that contacts the developer forming the image on the recording sheet to apply tension to the one of the pressing member and the fixing member. The cleaner is disposed at a position to contact the tension roller and is configured to remove contaminants including the developer adhered to the tension roller.

This specification further describes an image forming method according to one exemplary embodiment of the invention. In one aspect of the present invention, the novel image forming method includes forming an image on a recording medium with a developer according to image data, transporting the recording medium having the image thereon through a fixing nip formed between a pressing member and a fixing member, applying heat and pressure to the recording medium having the image while the recording medium passes through the fixing nip, contacting a tension roller to one of the pressing member and the fixing member that contacts the developer forming the image on the recording sheet to apply tension to the one of the pressing member and the fixing member, removing contaminants including the developer from the one of the pressing member and the fixing member by using the tension roller, and contacting a cleaner to the tension roller to remove the contaminants including the developer from the tension roller.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
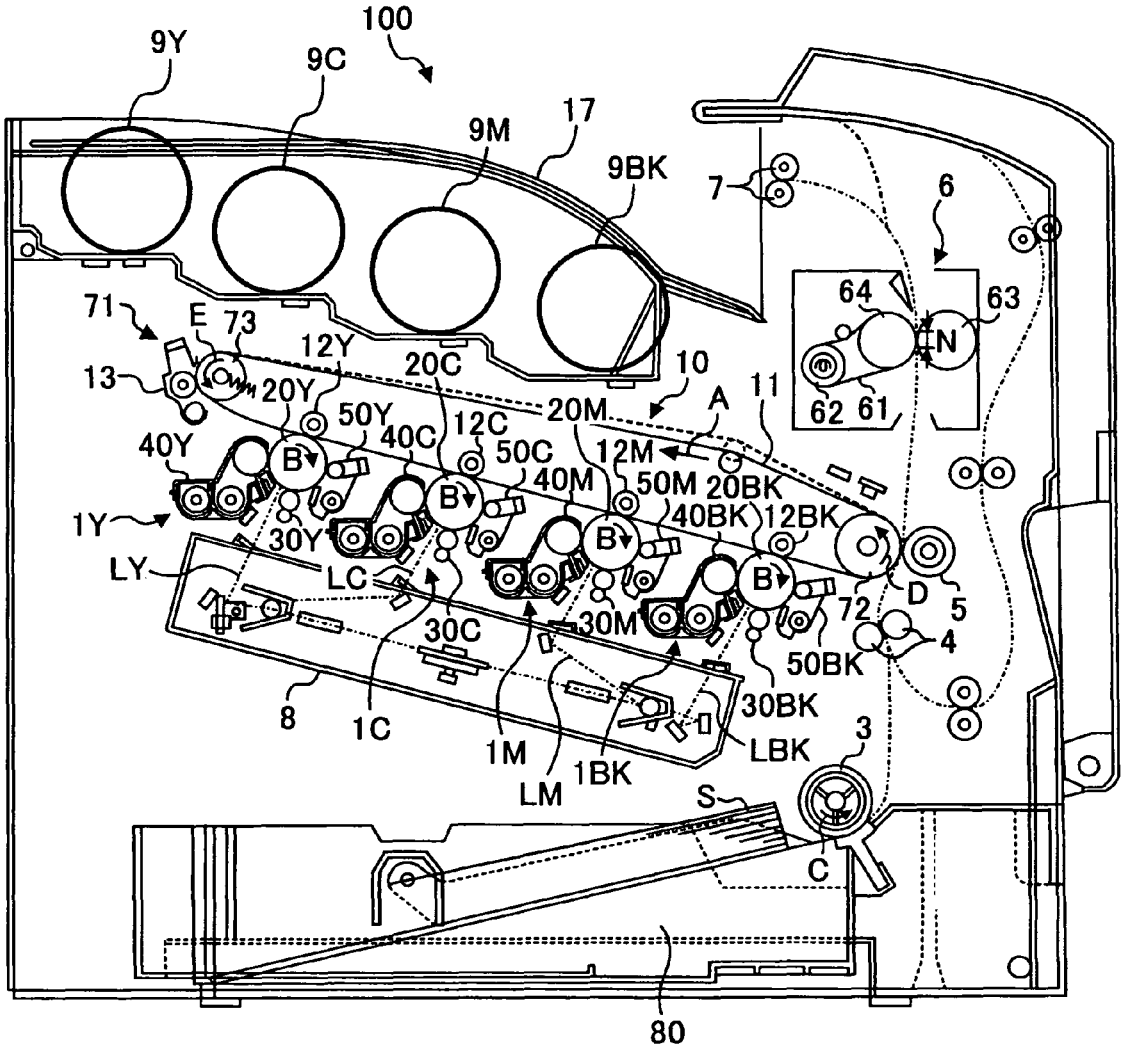
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus 100 according to an exemplary embodiment of the present invention is explained.

As illustrated in FIG. 1, the image forming apparatus 100 includes image stations 1Y, 1C, 1M, and 1BK, an optical scanning unit 8, toner bottles 9Y, 9C, 9M, and 9BK, a transferor 71, a paper tray 80, registration rollers 4, a fixing unit 6, output rollers 7, and an output tray 17.

The image stations 1Y, 1C, 1M, and 1BK respectively include photoconductors 20Y, 20C, 20M, and 20BK, chargers 30Y, 30C, 30M, and 30BK, development units 40Y, 40C, 40M, and 40BK, and cleaning units 50Y, 50C, 50M, and 50BK. The transferor 71 includes a transfer belt unit 10 (including a transfer belt 11, first transfer rollers 12Y, 12C, 12M, and 12BK, a driving roller 72, and a driven roller 73), a second transfer roller 5, and a belt cleaner 13. The paper tray 80 includes a feeding roller 3. The fixing unit 6 includes a fixing belt 61, a heating roller 62, a fixing roller 64, and a pressure roller 63.

The image forming apparatus 100 forms an image on a recording medium (i.e., a recording sheet S) in an electrophotographic method. According to this non-limiting exemplary embodiment, the image forming apparatus 100 functions as a color printer. However, the image forming apparatus 100 may include a copying machine, a facsimile machine, a printing machine, and a multifunction printer having copying, facsimile, printing, and/or other functions and may form a color and/or monochrome image.

The image stations 1Y, 1C, 1M, and 1BK respectively form toner images in yellow, cyan, magenta, and black colors. The photoconductors 20Y, 20C, 20M, and 20BK are disposed in tandem along a rotating direction A in this order and rotate in a rotating direction B. The photoconductors 20Y, 20C, 20M, and 20BK respectively carry toner images in the yellow, cyan, magenta, and black colors. The chargers 30Y, 30C, 30M, and 30BK, the development units 40Y, 40C, 40M, and 40BK, the first transfer rollers 12Y, 12C, 12M, and 12BK, and the cleaning units 50Y, 50C, 50M, and 50BK are respectively disposed in this order in the rotating direction B around the photoconductors 20Y, 20C, 20M, and 20BK.

The chargers 30Y, 30C, 30M, and 30BK uniformly charge surfaces of the photoconductors 20Y, 20C, 20M, and 20BK respectively. The optical scanning unit 8 is disposed under the image stations 1Y, 1C, 1M, and 1BK and opposes to the image stations 1Y, 1C, 1M, and 1BK. The optical scanning unit 8 includes a light source (e.g., a semiconductor laser), a coupling lens, an fθ lens, a toroidal lens, a mirror, and a polygon mirror. The optical scanning unit 8 irradiates lights LY, LC, LM, and LBK onto the surfaces of the photoconductors 20Y, 20C, 20M, and 20BK to form electrostatic latent images according to image data. The toner bottles 9Y, 9C, 9M, and 9BK are disposed under the output tray 17 and respectively contain yellow, cyan, magenta, and black toners. The development units 40Y, 40C, 40M, and 40BK respectively contain the yellow, cyan, magenta, and black toners supplied from the toner bottles 9Y, 9C, 9M, and 9BK and visualize the electrostatic latent images formed on the surfaces of the photoconductors 20Y, 20C, 20M, and 20BK with the yellow, cyan, magenta, and black toners to form toner images.

The transferor 71 is disposed above the image stations 1Y, 1C, 1M, and 1BK and opposes the image stations 1Y, 1C, 1M, and 1BK. The transfer belt 11 is looped over the driving roller 72 and the driven roller 73. The driving roller 72 rotates in a rotating direction D to rotate the transfer belt 11 in the rotating direction A. The rotating transfer belt 11 rotates the driven roller 73 in a rotating direction E. The driven roller 73 includes a force applier (e.g., a spring) to tension the transfer belt 11. The transfer belt 11 is formed in an endless belt shape and faces the photoconductors 20Y, 20C, 20M, and 20BK. The first transfer rollers 12Y, 12C, 12M, and 12BK respectively oppose to the photoconductors 20Y, 20C, 20M, and 20BK via the transfer belt 11 and apply a voltage to perform a first transfer in which the toner images formed on the surfaces of the photoconductors 20Y, 20C, 20M, and 20BK are superimposed and transferred in this order onto a common portion on an outer circumferential surface of the rotating transfer belt 11 at different timings to form a color toner image.

The cleaning units 50Y, 50C, 50M, and 50BK respectively remove residual toner not transferred and remaining on the surfaces of the photoconductors 20Y, 20C, 20M, and 20BK.

The paper tray 80 is disposed in a lower portion of the image forming apparatus 100 and loads recording sheets S. The feeding roller 3 contacts an uppermost recording sheet S and rotates in a rotating direction C to feed the uppermost recording sheet S toward the registration rollers 4. The registration rollers 4 feed the recording sheet S toward the transferor 71 at a timing when the color toner image formed on the outer circumferential surface of the transfer belt 11 is properly transferred onto the recording sheet S. A sensor (not shown) detects a head of the recording sheet S which reaches the registration rollers 4.

The second transfer roller 5 opposes the transfer belt 11 and rotates in accordance with rotation of the transfer belt 11. The second transfer roller 5 performs a second transfer in which the color toner image formed on the outer circumferential surface of the transfer belt 11 is transferred onto the recording sheet S which is conveyed through a nip formed between the transfer belt 11 and the second transfer roller 5.

The belt cleaner 13 includes a cleaning brush (not shown) and a cleaning blade (not shown) disposed to oppose and contact the transfer belt 11 to clean the outer circumferential surface of the transfer belt 11 by scraping and removing contaminants including residual toner particles from the outer circumferential surface of the transfer belt 11. The belt cleaner 13 further includes an ejector (not shown) for conveying the removed toner particles to be discarded.

The recording sheet S having the color toner image is fed toward the fixing unit 6. In the fixing unit 6, the fixing belt 61 is looped over the heating roller 62 and the fixing roller 64. The fixing roller 64 opposes the pressure roller 63 via the fixing belt 61. While the recording sheet S is conveyed through a nip N formed between the fixing belt 61 and the pressure roller 63, heat applied by the fixing belt 61 and pressure applied by the pressure roller 63 fix the color toner image on the recording sheet S. The output rollers 7 feed the recording sheet S having the fixed color toner image onto the output tray 17 disposed in an upper portion of the image forming apparatus 100.

According to this non-limiting exemplary embodiment, the toner images in the yellow, cyan, magenta, and black colors respectively formed on the surfaces of the photoconductors 20Y, 20C, 20M, and 20BK are superimposed and transferred onto the outer circumferential surface of the transfer belt 11 to form a color toner image, and then the color toner image is transferred onto the recording sheet S. However, the image forming apparatus 100 may also be configured to carry the recording sheet S on the transfer belt 11 so that the toner images in the yellow, cyan, magenta, and black colors respectively formed on the surfaces of the photoconductors 20Y, 20C, 20M, and 20BK are directly superimposed and transferred onto the recording sheet S.

Figure 2:
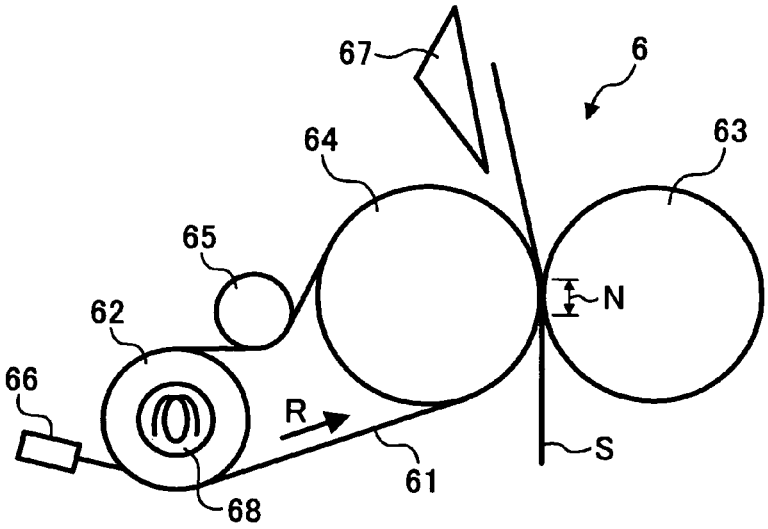
FIG. 2 is a schematic view of a belt type fixing unit of the image forming apparatus shown in FIG. 1.

As illustrated in FIG. 2, the fixing unit 6 further includes a tension roller 65, a heater 68, a thermistor 66, and a separating nail 67. The tension roller 65 tensions the fixing belt 61 rotating in a rotating direction R. The thermistor 66 detects a temperature of a surface of the fixing belt 61.

The pressure roller 63 includes a core, an elastic layer, and a releasing layer. The core includes aluminum and/or iron. The elastic layer includes a silicone rubber and is formed on the core. The releasing layer includes PFA (perfluoroalkoxy) and/or PTFE (polytetrafluoroethylene) and forms a surface layer. The fixing belt 61 includes a base, an elastic layer, and/or a releasing layer. The base includes nickel and/or polyimide. The releasing layer includes PFA and/or PTFE. The elastic layer includes a silicone rubber and is formed between the base and the releasing layer. The tension roller 65 applies a proper tension to the fixing belt 61 looped over the fixing roller 64 and the heating roller 62. The fixing roller 64 includes a core including a metal and an elastic layer including a silicone rubber. The heating roller 62 is formed in a hollow cylindrical shape and includes aluminum or iron. The heater 68 (e.g., a halogen heater) is disposed in a hollow created by the hollow cylindrical shape of the heating roller 62.

The fixing roller 64 and the pressure roller 63 respectively apply heat and pressure to the recording sheet S having the color toner image while the recording sheet S is conveyed through the nip N formed between the fixing belt 61 and the pressure roller 63 to fix the color toner image on the recording sheet S. The separating nail 67 guides the recording sheet S having the fixed color toner image upward. The separating nail 67 may be formed in a board-like shape.

Toner particles of the color toner image on the recording sheet S may be adhered to the fixing belt 61 while the recording sheet S is conveyed through the nip N formed between the fixing belt 61 and the pressure roller 63. The toner particles may be further transferred from the fixing belt 61 onto the tension roller 65. The toner particles accumulated on the tension roller 65 may be transferred onto the fixing belt 61 again. The transferred toner particles may be further transferred onto a following recording sheet S which is conveyed through the nip N formed between the fixing belt 61 and the pressure roller 63, forming a spot on the following recording sheet S. As a result, a faulty image may be formed on the following recording sheet S.

When the tension roller 65 is configured to include PFA to easily release the toner particles adhered to the tension roller 65 to address the above-described problem, the toner particles not adhered to the tension roller 65 may be accumulated on the fixing belt 61 and the pressure roller 63. The toner particles adhered to the fixing belt 61 and the pressure roller 63 may be transferred onto a following recording sheet S which is conveyed through the nip N formed between the fixing belt 61 and the pressure roller 63, forming a spot on the following recording sheet S. The tension roller 65 including PFA generally causes decreased friction with the fixing belt 61. When the tension roller 65 is configured to rotate in accordance with rotation of the fixing belt 61, the tension roller 65 may slip on the fixing belt 61. The tension roller 65 which does not properly rotate may hold the toner particles and the toner particles may be accumulated on the tension roller 65. The accumulated toner particles may escape from the tension roller 65 and may be transferred onto the fixing belt 61. The transferred toner particles may be further transferred onto a following recording sheet S which is conveyed through the nip N formed between the fixing belt 61 and the pressure roller 63, forming a spot on the following recording sheet S.

Figure 3:
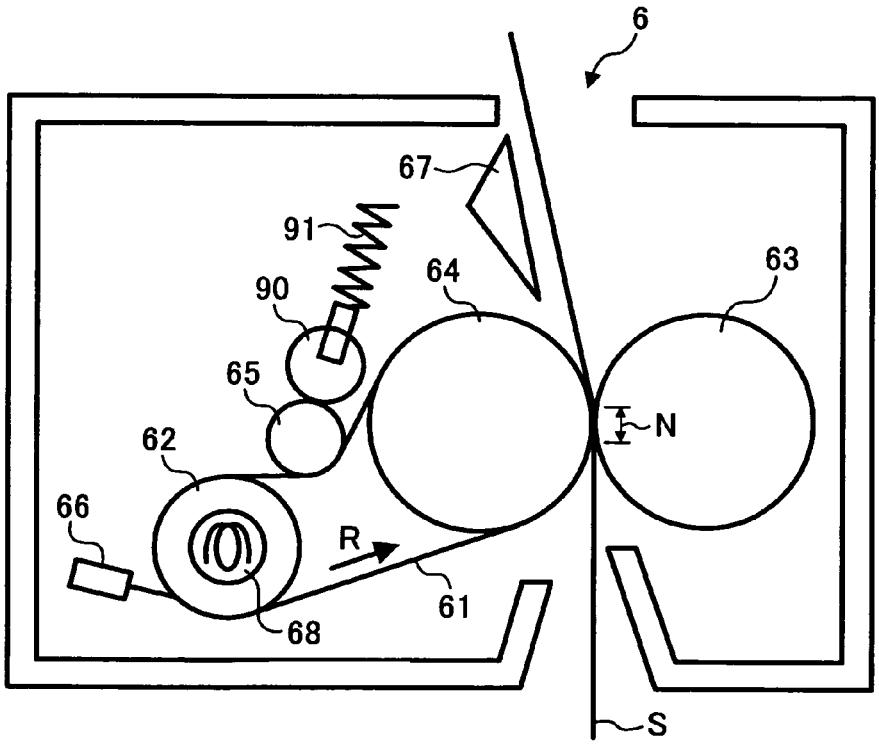
FIG. 3 is a schematic view of a cleaner of the fixing unit shown in FIG. 2.

To cope with the above-described problems, the fixing unit 6 further includes a cleaner 90 and a spring 91 as illustrated in FIG. 3. The cleaner 90 contacts or pressingly contacts the tension roller 65 to remove the toner particles adhered to the tension roller 65. The cleaner 90 is formed in a web-like shape or a roller-like shape. The spring 91 presses the cleaner 90 toward the tension roller 65.

Figure 4A:
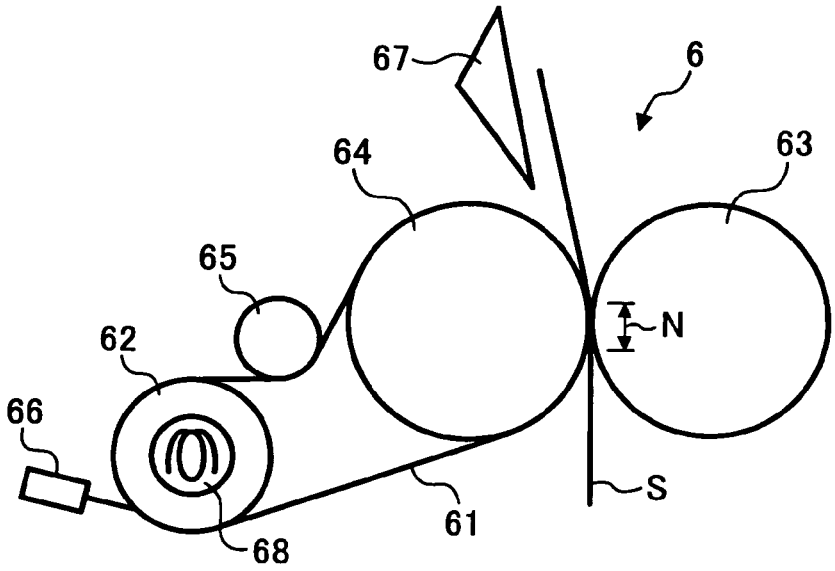
FIG. 4A is a schematic view of a tension roller contacting a fixing belt in the fixing unit shown in FIG. 2.

As illustrated in FIG. 4A, the tension roller 65 contacts the fixing belt 61 with an increased pressure. The tension roller 65 and the fixing belt 61 contact each other at a substantial area where toner particles are adequately heated to have a sufficient viscosity. Thus, the toner particles may be easily adhered to the tension roller 65.

Figure 4B:
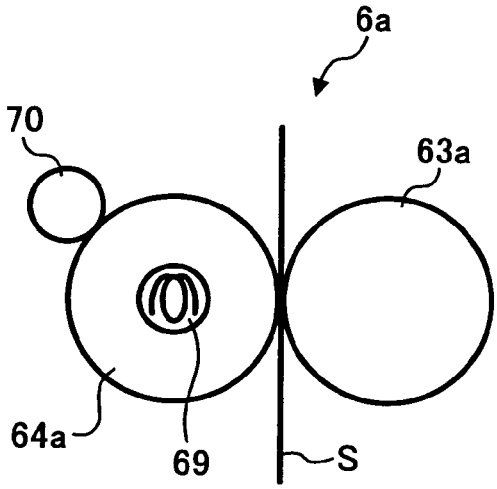
FIG. 4B is a schematic view of a cleaning roller contacting a fixing roller in a roller type fixing unit.

FIG. 4B illustrates a fixing unit 6*a* including a roller-shaped fixing member. The fixing unit 6*a* includes a pressure roller 63*a*, a fixing roller 64*a* (including a heater 69), and a cleaning roller 70. The fixing roller 64*a* and the pressure roller 63*a* respectively apply heat and pressure to a recording sheet S which is conveyed through a nip formed under pressure between the fixing roller 64*a* and the pressure roller 63*a* to fix a toner image on the recording sheet S. The heater 69 heats the fixing roller 64*a*. The cleaning roller 70 contacts the fixing roller 64*a* to remove toner particles adhered to a surface of the fixing roller 64*a*. The cleaning roller 70 contacts the fixing roller 64*a* with a pressure lower than the pressure applied by the tension roller 65 to the fixing belt 61 of the fixing unit 6 illustrated in FIG. 4A. The cleaning roller 70 and the fixing roller 64*a* contact each other at a small area where toner particles are not heated to have a sufficient viscosity. Thus, the toner particles may not be easily adhered to the cleaning roller 70.

Figure 5A:
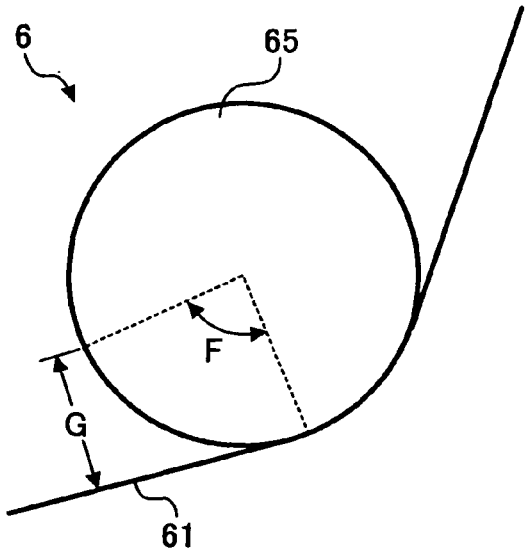
FIG. 5A is a schematic view of the tension roller moving on the fixing belt shown in FIG. 4A.

As illustrated in FIG. 5A, centers of curvature of the tension roller 65 and the fixing belt 61 are provided on a common side because a part on the tensioned surface of the fixing belt 61 contacts a circumferential surface of the tension roller 65.

Figure 5B:
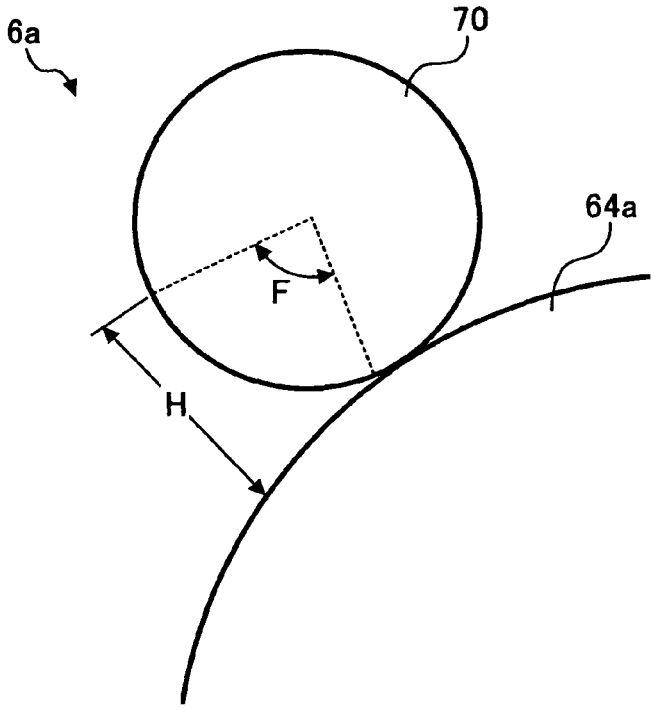
FIG. 5B is a schematic view of the cleaning roller moving on the fixing roller shown in FIG. 4B.

Thus, the tension roller 65 and the fixing belt 61 contact each other at an area larger than an area where the cleaning roller 70 and the fixing roller 64*a* contact each other, as illustrated in FIG. 5B. Specifically, when the tension roller 65 and the cleaning roller 70 have a common diameter and rotate for a common angle (i.e., an angle F as illustrated in FIGS. 5A and 5B), a distance G formed between the tension roller 65 and the fixing belt 61, as illustrated in FIG. 5A, may be shorter than a distance H formed between the cleaning roller 70 and the fixing roller 64*a* as illustrated in FIG. 5B.

Figure 6A:
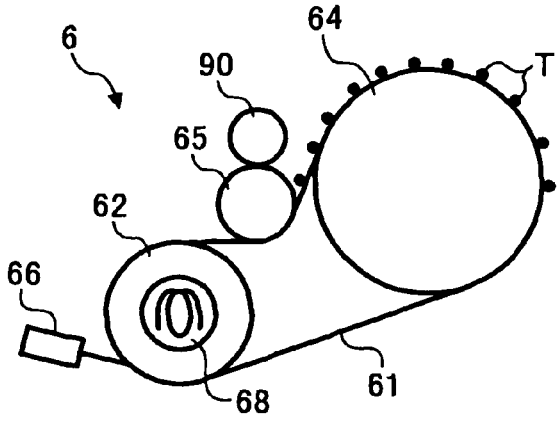
FIG. 6A is a schematic view of the tension roller removing toner particles from the fixing belt shown in FIG. 4A.
Figure 6B:
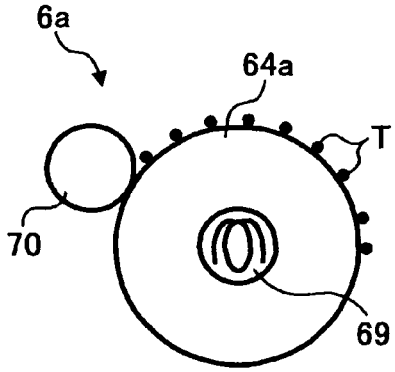
FIG. 6B is a schematic view of the cleaning roller removing toner particles from the fixing roller shown in FIG. 4B.

As illustrated in FIG. 6A, portions on the rotating tension roller 65 and the rotating fixing belt 61 separate from each other by taking time after contacting each other. Thus, the portion on the tension roller 65 may pick up toner particles T before separating from the fixing belt 61. As illustrated in FIG. 6B, portions on the rotating cleaning roller 70 and the rotating fixing roller 64*a* separate from each other by taking a shorter time than the tension roller 65 and the fixing belt 61 illustrated in FIG. 6A after contacting each other, because centers of curvature of the cleaning roller 70 and the fixing roller 64*a* oppose each other. The portion on the cleaning roller 70 quickly separates from the fixing roller 64*a* after contacting the fixing roller 64*a*. As a result, the cleaning roller 70 may not completely pick up toner particles T.

The cleaner 90 contacting the tension roller 65 applies a force which reduces a rotating speed of the tension roller 65 and thereby causes the tension roller 65 to slide on the rotating fixing belt 61. However, the force applied by the cleaner 90 contacting the tension roller 65 may be adjusted to prevent the tension roller 65 from stopping rotating and completely sliding on the fixing belt 61. When the tension roller 65 is configured to rotate at a speed slower than a rotating speed of the fixing belt 61 as described above, the tension roller 65 may scrape the toner particles T. When a driver (not shown) is provided to rotate the tension roller 65 at a speed faster than the rotating speed of the fixing belt 61, the tension roller 65 may also scrape the toner particles T.

According to this non-limiting exemplary embodiment, the toner particles T may be removed from the surface of the fixing belt 61 by using the physical property (i.e., the releasing property of the fixing belt 61) as well as the mechanical structure for scraping the toner particles T. The cleaner 90 contacting the tension roller 65 may pick up the removed toner particles T, providing an effective toner removal mechanism which maintains proper removal of the toner particles T.

A nip formed under pressure between the fixing belt 61 and the tension roller 65 may have a length of about 1.5 mm or longer and a contacting pressure of about 10 N or greater. The tension roller 65 and the cleaner 90 may include a metal, a rubber, or a resin as long as the tension roller 65 and the cleaner 90 are formed in a roller-like shape.

The cleaner 90 removes toner particles T adhered to the surface of the tension roller 65 to reduce or prevent the toner particles T from being accumulated on the surface of the tension roller 65 and further being transferred onto the surface of the fixing belt 61 again. The centers of curvature of the tension roller 65 and the fixing belt 61 are on the common side. Therefore, the tension roller 65 contacts the surface of the fixing belt 61 for a longer period of time than the cleaning roller 70 contacting the fixing roller 64*a* when the tension roller 65 and the cleaning roller 70 respectively move on the surfaces of the fixing belt 61 and the fixing roller 64*a*, because the centers of curvature of the cleaning roller 70 and the fixing roller 64*a* oppose each other. The tension roller 65 may remove more toner particles T from the surface of the fixing belt 61 than the cleaning roller 70 which removes toner particles T from the surface of the fixing roller 64*a*. As a result, no toner particles T may remain on the surface of the fixing belt 61.

The tension roller 65 includes a surface layer including a material having an increased releasing property (e.g., PFA and/or PTFE). Thus, toner particles T picked up by the cleaner 90 may not be transferred onto the surface of the tension roller 65. If the cleaning roller 70 contacting the fixing roller 64*a* includes the material having the increased releasing property, the cleaning roller 70 may not pick up toner particles T from the surface of the fixing roller 64*a*. According to this non-limiting exemplary embodiment, the tension roller 65 may pick up toner particles T from the surface of the fixing belt 61 even if the tension roller 65 includes the surface layer including the material having the increased releasing property.

The tension roller 65 having the increased releasing property may prevent toner particles T picked up by the cleaner 90 from being transferred onto the surface of the tension roller 65.

The releasing property of the tension roller 65 is not increased as much as releasing properties of the fixing belt 61 and the pressure roller 63 to cause the tension roller 65 to pick up toner particles T from the surface of the fixing belt 61 with an increased efficiency. Specifically, the releasing property of the fixing belt 61, which is more increased than the releasing property of the tension roller 65, may cause the tension roller 65 to effectively pick up the toner particles T from the surface of the fixing belt 61. The fixing belt 61 may include a non-conductive PFA. The pressure roller 63 and the tension roller 65 may include a conductive PFA. The conductive PFA generally includes an additive and thereby has a decreased releasing property. Further, when the surface layer of the tension roller 65 includes PFA having a releasing property which is slightly decreased compared to the releasing property of the pressure roller 63, the tension roller 65 may pick up more toner particles T than the pressure roller 63, reducing or preventing the toner particles T from being adhered to a surface of the pressure roller 63.

The releasing property of the tension roller 65 may be configured to be equivalent to or lower than the releasing property of the fixing belt 61 or the pressure roller 63. Toner particles T may be adhered to the tension roller 65 more easily than the fixing belt 61 and the pressure roller 63, reducing or preventing the toner particles T from being adhered to the fixing belt 61 and the pressure roller 63.

The tension roller 65 contacting the fixing belt 61 may draw heat from the fixing belt 61. Specifically, when the image forming apparatus 100 is powered on after powered off for a substantial period of time, the cooled tension roller 65 may prevent a temperature of the fixing belt 61 from quickly increasing during warm-up. To avoid this, the tension roller 65 may include a releasing layer including a material having a low thermal conductivity (e.g., a resin and/or a foamed rubber).

The tension roller 65 has a thermal conductivity lower than a thermal conductivity of the fixing belt 61. Thus, the tension roller 65 may not easily draw heat from the fixing belt 61 and the fixing belt 61 may properly be heated to a predetermined temperature.

The surface layer of the tension roller 65 includes a porous body to cause the tension roller 65 to pick up toner particles T from the surface of the fixing belt 61 with increased efficiency. Pores formed on the surface of the tension roller 65 scrape the toner particles T on the fixing belt 61. Specifically, the surface layer of the tension roller 65 may include a foamed rubber (e.g., a sponge-like silicone rubber). Thus, the above-described mechanical structure may stably remove the toner particles T from the surface of the fixing belt 61.

The surface layer of the tension roller 65 has the porous structure. The pores formed on the surface of the tension roller 65 may contact the surface of the fixing belt 61 and may easily scrape toner particles T adhered to the surface of the fixing belt 61.

The cleaner 90 removes toner particles T from the surface of the tension roller 65. However, when the removed toner particles T are accumulated on a surface of the cleaner 90, the cleaner 90 may have a longer diameter. If a distance between axes of the cleaner 90 and the tension roller 65 is fixed, the longer diameter may affect torque of the cleaner 90 and the tension roller 65 and may stop the rotating cleaner 90 and the rotating tension roller 65. To reduce or prevent this, the distance between the axes of the cleaner 90 and the tension roller 65 is configured to become longer when the diameter of the cleaner 90 becomes longer. Specifically, as illustrated in FIG. 3, an elastic body including the spring 91 is configured to press the cleaner 90 toward the tension roller 65 in a manner that the cleaner 90 pressingly contacts the tension roller 65. Thus, the cleaner 90 is configured to be movable.

An elastic force causes the cleaner 90 to pressingly contact the tension roller 65 in a manner that the cleaner 90 rotates in accordance with rotation of the tension roller 65. Even when the distance between the axes of the cleaner 90 and the tension roller 65 is changed due to the toner particles T accumulated on the surface of the cleaner 90, the cleaner 90 may properly contact the tension roller 65 to maintain a cleaning efficiency.

The cleaner 90 includes a surface layer including a porous body to cause the tension roller 65 to pick up toner particles T from the surface of the fixing belt 61 with increased efficiency. Pores formed on the surface of the cleaner 90 scrape toner particles T on the tension roller 65. The cleaner 90 including the porous body may have a greater surface area, increasing a maximum amount of toner particles T scraped by the cleaner 90. Specifically, the surface layer of the cleaner 90 may include a foamed rubber (e.g., a sponge-like silicone rubber).

The surface layer of the cleaner 90 has the porous structure. The pores formed on the surface of the cleaner 90 may easily scrape toner particles T adhered to the surface of the tension roller 65. The pores formed on the surface of the cleaner 90 may also increase the surface area of the cleaner 90, increasing the maximum amount of toner particles T scraped by the cleaner 90. As a result, the toner particles T may be removed from the surface of the tension roller 65 with an increased cleaning efficiency.

The surface layer of the cleaner 90 may include a fiber to cause the tension roller 65 to pick up toner particles from the surface of the fixing belt 61 with increased efficiency. The fiber of the cleaner 90 may scrape toner particles T on the tension roller 65 like a brush. The cleaner 90 may have a surface area greater than the surface area created by the porous body, further increasing the maximum amount of toner particles T scraped by the cleaner 90. Specifically, the surface layer of the cleaner 90 may include a brush and felt formed in a roller-like shape.

The surface layer of the cleaner 90 includes the fiber (e.g., felt). The fiber may scrape toner particles T adhered to the surface of the tension roller 65 with an increased efficiency. The fiber may also increase the surface area of the cleaner 90, increasing the maximum amount of the toner particles T scraped by the cleaner 90. As a result, the toner particles T may be removed from the surface of the tension roller 65 with an increased cleaning efficiency.

Figure 7:
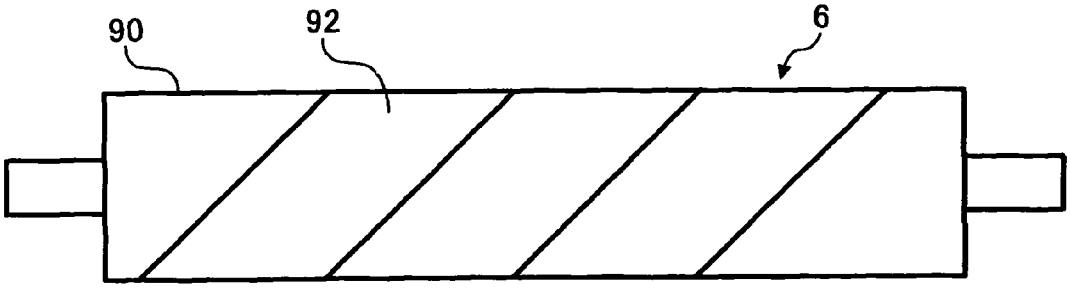
FIG. 7 is an axial view of the cleaner shown in FIG. 3.

To increase the cleaning efficiency of the cleaner 90 including the fiber, felt is wrapped around an outer circumferential surface of the cleaner 90. As illustrated in FIG. 7, the fixing unit 6 further includes a felt 92 configured to pick up toner particles adhered to the surface of the tension roller 65. The felt 92 is wrapped around the outer circumferential surface of the cleaner 90 along an axial direction of the cleaner 90 like a spiral. When the felt is wrapped around the outer circumferential surface of the cleaner 90, joints are formed and toner particles are easily accumulated on the joints. If the joints are formed in a circumferential direction of the cleaner 90, the toner particles fixed on the joints may fall onto the tension roller 65 or the fixing belt 61 and may be transferred onto a toner image on a recording sheet S while the recording sheet S is conveyed through the nip formed under pressure between the fixing belt 61 and the pressure roller 63. If the felt 92 is wrapped around the outer circumferential surface of the cleaner 90 like the spiral, the toner particles fixed on the joints may be dispersed along the axial direction of the cleaner 90, reducing the likelihood or preventing the toner particles fixed on the joints from falling onto the tension roller 65 or the fixing belt 61.

The felt 92 is wrapped around the outer circumferential surface of the cleaner 90 along the axial direction of the cleaner 90, particularly like the spiral. Thus, the joints may not concentrate on certain parts on the cleaner 90 along the axial direction of the cleaner 90, reducing or preventing toner particles from being accumulated on the parts. As a result, a faulty image may not be formed on a recording sheet S due to the toner particles accumulated on the joints.

As illustrated in FIG. 2, the tension roller 65 is disposed upstream of the thermistor 66 in the rotating direction R of the fixing belt 61 with respect to the nip N. Specifically, the thermistor 66 is disposed upstream of the nip N and downstream of the tension roller 65 in the rotating direction R of the fixing belt 61. The tension roller 65 picks up toner particles from the surface of the fixing belt 61 before the toner particles reach the thermistor 66. Thus, the toner particles may not be accumulated on the thermistor 66, reducing or preventing the thermistor 66 from erroneously detecting the temperature of the fixing belt 61.

The thermistor 66 is disposed upstream of the nip N and downstream of the tension roller 65 in the rotating direction R of the fixing belt 61. The thermistor 66 may contact the surface of the fixing belt 61 after the tension roller 65 picks up toner particles from the surface of the fixing belt 61. Thus, the toner particles may not be transferred from the surface of the fixing belt 61 and may not be accumulated on the thermistor 66, reducing the likelihood or preventing the thermistor 66 from erroneously detecting the temperature of the fixing belt 61.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative embodiments may be combined with each other and/or substituted for each other within the scope of the present invention.

What is claimed is:

1. An image forming apparatus, comprising:

an image forming mechanism configured to form an image on a recording medium with a developer according to image data; and a fixing mechanism configured to fix the developer forming the image on the recording medium and including a pressing member configured to apply pressure to the recording medium, a fixing member opposing the pressing member and configured to apply heat to the recording medium conveyed through a nip formed between the pressing member and the fixing member, a tension roller disposed at a position to contact an outer surface of the fixing member that contacts the developer forming the image on the recording medium to apply tension to the fixing member, the tension roller rotating in accordance with rotation of the fixing member and having a releasing property of an outer surface thereof that releases the developer therefrom which is lower than a releasing property of the outer surface of the fixing member that releases the developer therefrom, and a cleaner disposed at a position to contact the outer surface of the tension roller and configured to remove contaminants including the developer adhered to the tension roller, the cleaner configured to pressingly contact the tension roller by an elastic force so that the tension roller slides on the outer surface of the fixing member.

2. The image forming apparatus according to claim 1, wherein the fixing member is formed in a belt-like shape and includes a part contacting a circumferential surface of the tension roller.

3. The image forming apparatus according to claim 2, wherein the tension roller has a thermal conductivity lower than a thermal conductivity of the fixing member to which the tension roller applies tension.

4. The image forming apparatus according to claim 2, further comprising:

a thermistor disposed upstream of the nip formed between the pressing member and the fixing member and downstream of the tension roller in a rotating direction of the one of the pressing member and the fixing member and configured to contact an outer circumferential surface of the one of the pressing member and the fixing member.

5. The image forming apparatus according to claim 1, wherein the tension roller includes a surface layer including a porous body.

6. The image forming apparatus according to claim 1, wherein the cleaner includes a surface layer including a porous body.

7. The image forming apparatus according to claim 1, wherein the cleaner includes a surface layer including a fiber.

8. The image forming apparatus according to claim 1, wherein the cleaner is formed in a roller-like shape and the surface layer of the cleaner includes felt wrapped around an outer circumferential surface of the cleaner.

9. The image forming apparatus according to claim 8, wherein the felt is wrapped around the outer circumferential surface of the cleaner along an axial direction of the cleaner.

10. The image forming apparatus according to claim 9, wherein the felt is wrapped around the outer circumferential surface of the cleaner along the axial direction of the cleaner like a spiral.

11. A fixing unit for fixing a developer forming an image on a recording medium, comprising:

a pressing member configured to apply pressure to the recording medium;

a fixing member opposing the pressing member and configured to apply heat to the recording medium conveyed through a nip formed between the pressing member and the fixing member;

a tension roller disposed at a position to contact an outer surface of the fixing member that contacts the developer forming the image on the recording medium to apply tension to the fixing member, the tension roller rotating in accordance with rotation of the fixing member and having a releasing property of an outer surface thereof that releases the developer therefrom which is lower than a releasing property of the outer surface of the fixing member that releases the developer therefrom; and a cleaner disposed at a position to contact the outer surface of the tension roller and configured to remove contaminants including the developer adhered to the tension roller, the cleaner configured to pressingly contact the tension roller by an elastic force so that the tension roller slides on the outer surface of the fixing member.

12. An image forming method, comprising:

forming an image on a recording medium with a developer according to image data;

transporting the recording medium having the image thereon through a fixing nip formed between a pressing member and a fixing member;

applying heat and pressure to the recording medium having the image while the recording medium passes through the fixing nip;

contacting a tension roller to an outer surface of the fixing member that contacts the developer forming the image on the recording medium to apply tension to the fixing member, the tension roller rotating in accordance with rotation of the fixing member and having a releasing property of an outer surface thereof that releases the developer therefrom which is lower than a releasing property of the outer surface of the fixing member that releases the developer therefrom;

removing contaminants including the developer from the fixing member using the tension roller;

contacting a cleaner to the outer surface of the tension roller to remove the contaminants including the developer from the tension roller; and rotating the cleaner such that the cleaner rotates in accordance with rotation of the tension roller due to pressing contact between the tension roller and the cleaner so that the tension roller slides on the outer surface of the fixing member.

* * * * *